US005363181A

United States Patent [19]

Lindblad et al.

[11] Patent Number: 5,363,181

[45] Date of Patent: Nov. 8, 1994

[54] MULTI-FUNCTIONAL BELT/BLADE CLEANER

[75] Inventors: Nero R. Lindblad, Ontario; Ronald Godlove, Bergen, both of N.Y.

[73] Assignee: Xerox Corporation, Stamford, Conn.

[21] Appl. No.: 990,846

[22] Filed: Dec. 14, 1992

[51] Int. Cl.[5] ..... G03G 21/00; A46B 15/00

[52] U.S. Cl. ..... 355/299; 15/256.5; 355/300

[58] Field of Search ..... 75/256.5, 256.51, 256.52; 355/296, 297, 299, 300, 301

[56] References Cited

U.S. PATENT DOCUMENTS

| | | | |
|---|---|---|---|
| Re. 29,632 | 5/1978 | Tanaka et al. | 355/298 X |
| 3,583,555 | 6/1971 | Karsnak | 15/256.5 X |
| 3,706,108 | 12/1972 | Taylor | 15/256.51 |
| 3,983,888 | 10/1976 | Edwards | 15/256.5 |
| 4,406,039 | 9/1983 | Hotz | 15/256.51 X |
| 4,568,174 | 2/1986 | Stange | 15/256.51 |
| 4,755,412 | 7/1988 | Glans et al. | 428/121 |
| 4,787,500 | 11/1988 | Holz | 15/256.5 X |
| 4,840,267 | 6/1989 | Pine | 15/256.5 X |
| 4,862,221 | 8/1989 | Tabuchi et al. | 15/256.5 X |
| 4,868,029 | 9/1989 | Nakagawa et al. | 428/163 |
| 4,946,727 | 8/1990 | Kessler | 428/99 |
| 5,081,505 | 1/1992 | Ziegelmuller et al. | 15/256.5 X |
| 5,109,976 | 5/1992 | Mohri et al. | 15/256.52 X |
| 5,198,243 | 3/1993 | Shimizu et al. | 15/256.51 X |
| 5,208,639 | 5/1993 | Thayer et al. | 355/299 |

FOREIGN PATENT DOCUMENTS

| | | |
|---|---|---|
| 57-169780 | 10/1982 | Japan . |
| 58-68776 | 4/1983 | Japan . |
| 59-87481 | 5/1984 | Japan . |
| 61-103180 | 5/1986 | Japan . |
| 61-122679 | 6/1986 | Japan . |
| 62-11883 | 1/1987 | Japan . |
| 62-32484 | 2/1987 | Japan . |
| 62-251146 | 10/1987 | Japan . |
| 1-241587 | 9/1989 | Japan . |
| 2-259794 | 10/1990 | Japan . |
| 4-156492 | 5/1992 | Japan . |
| 957165 | 9/1982 | U.S.S.R. . |

OTHER PUBLICATIONS

Thayer, Photoreceptor Toner Cleaning Member, Xerox Disclosure Journal, vol. 4, No. 5, Sep./Oct. 1979, pp. 665–666.

*Primary Examiner*—A. T. Grimley
*Assistant Examiner*—Nestor R. Ramirez
*Attorney, Agent, or Firm*—Finnegan, Henderson, Farabow, Garrett & Dunner

[57] ABSTRACT

A multi-functional belt/blade cleaner removes toner and other residual processing debris from a processing surface in a photocopying machine. The multi-functional belt/blade cleaner includes a flexible cleaner belt having a plurality of blades formed by cuts in the cleaner belt. The cuts are made across the width and at intervals along the length of the cleaner belt to define individual blades having cleaning edges. The cleaner belt may be uniform or may comprise a plurality of belt segments, having different cleaning capabilities, connected together and mounted on a flexible supporting belt. In operation, the cleaner belt is revolved to periodically bring each of the cleaning edges into wiping contact with a processing surface, such as a photoreceptor, intermediate belt, ink imaging surface, or biased transfer surface.

23 Claims, 2 Drawing Sheets

MULTI-FUNCTIONAL BELT/BLADE CLEANER

BACKGROUND OF THE INVENTION

1. Field of the Invention

The present invention relates to surface cleaning, and, more particularly, to a multi-functional belt/blade cleaner for removing residual processing material, such as toner, ink, paper debris, and undesirable films from processing surfaces in photocopying machines.

2. Description of the Related Art

During the copying process in an electrophotographic copying (photocopying) machine, residual processing materials such as toner particles, paper debris, photoreceptor films, and ink, in the case of ink imaging systems, can accumulate on processing surfaces such as photoreceptor belts or drums, intermediate belts, ink imaging surfaces, and biased transfer surfaces. In ink imaging photocopiers, the liquid that carries the ink particles may dry onto imaging surfaces. The existence of such materials on photocopier processing surfaces can degrade image quality. Accordingly, a device for cleaning the adherent material from the processing surfaces is necessary to preserve the quality of the image.

Photocopying machines have typically used single cleaning blades in either a wiping mode or a doctoring mode to remove adherent material from photoreceptors. Due to excessive wear and insufficient reliability characteristics, however, such single-blade cleaning systems lack the durability desirable volume photocopying machines.

Alternatively, brush cleaning systems, some including a blower for detoning the brush with air, have been used to clean toner and other material from photoreceptors and biased transfer surfaces. However, such brush systems can be relatively expensive and, like the single-blade cleaning system, suffer from decreased effectiveness due to brush wear.

SUMMARY OF THE INVENTION

The present invention has been made in view of the above circumstances and has as an object a belt/blade cleaner for efficiently and reliably removing adherent material from surfaces, such as processing surfaces in photocopying machines.

Additional objects and advantages of the invention will be set forth in part in the description which follows, and in part will be obvious from the description, or may be learned by practice of the invention. The objects and advantages of the invention will be realized and attained by means of the elements and combinations particularly pointed out in the appended claims.

To achieve the above objects and in accordance with the purpose of the invention, as embodied and broadly described herein, the invention is a multi-functional belt/blade cleaner for removing material from a surface to be cleaned, the belt/blade cleaner comprising a cleaner belt having a length extending in a longitudinal direction, a width extending in a transverse direction substantially perpendicular to the longitudinal direction, and a predetermined thickness, a plurality of blades formed from the cleaner belt, the blades being formed by a plurality of cuts in the cleaner belt, the cuts being made across the width and at predetermined intervals along the length, each of the cuts having a depth less than the thickness, wherein areas on the cleaner belt between adjacent cuts define individual blades having cleaning edges, and means for mounting the cleaner belt to dispose the cleaning edges of the plurality of blades in wiping contact with the surface to remove the material.

It is to be understood that both the foregoing general description and the following detailed description are exemplary and explanatory only and are not restrictive of the invention, as claimed.

BRIEF DESCRIPTION OF THE DRAWINGS

The accompanying drawings, which are incorporated in and constitute a part of this specification, illustrate the embodiments of the invention and together with the description, serve to explain the principles of the invention.

DESCRIPTION OF THE PREFERRED EMBODIMENTS

Reference will now be made in detail to the presently preferred embodiments of the invention, examples of which are illustrated in the accompanying drawings. Wherever possible, the same reference numbers are used throughout the drawings to refer to the same or like parts. Description of the present invention in conjunction with particular types of processing surfaces is for purposes of example only, and is made in recognition of the utility of the multi-functional belt/blade cleaner in removing material from a variety of diverse surfaces.

During a photocopying process, a latent electrostatic image representing an original image is formed on a photoreceptor belt or drum and subsequently developed with toner. A biased transfer device then applies a bias charge to the moving photoreceptor as it passes, transferring the toner developed according to the latent electrostatic image to a sheet of paper. The biased transfer device may be in the form of a drum (a "biased transfer roll") positioned opposite the photoreceptor. During the photocopying process, untransfered toner, paper debris, and undesirable films may accumulate on both the photoreceptor and the biased transfer roll (BTR), as well as on intermediate belts, resulting in reduced image quality. If the BTR is not cleaned, toner and paper debris on the BTR is transferred to the back of the copy sheets, appearing as spots and smudges. If duplexed copies are run, the spots and smudges will appear on both sides of the copies.

Figure 1:
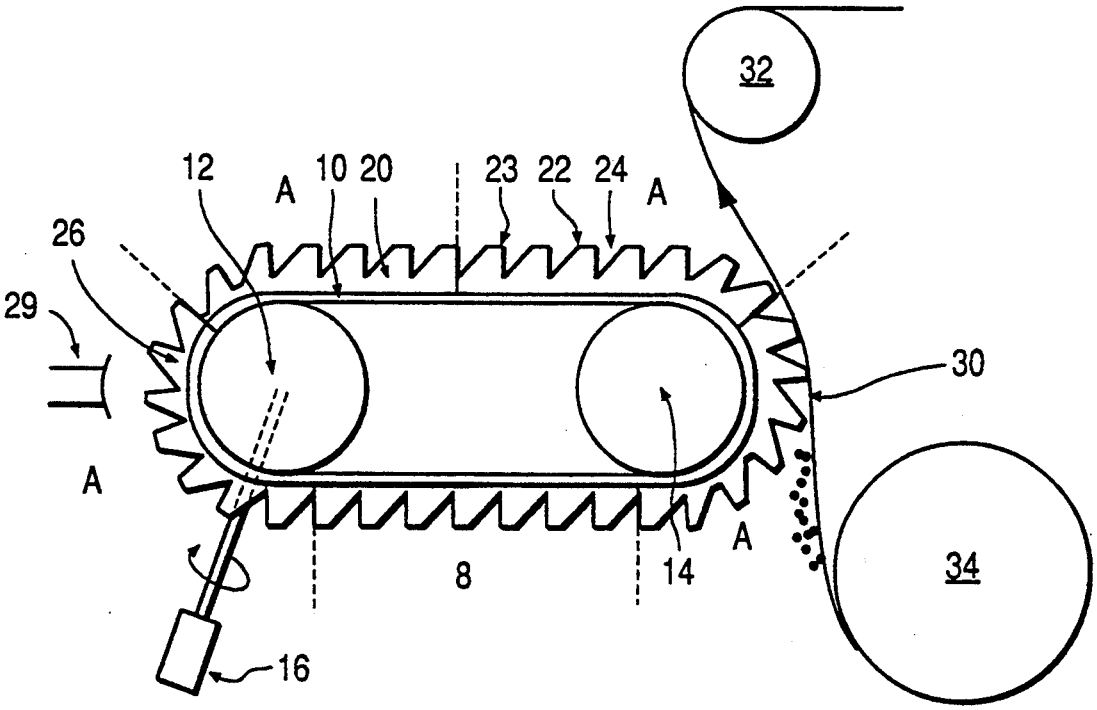
FIG. 1 illustrates one embodiment of a multi-functional belt/blade cleaner according to the present invention.

FIG. 1 illustrates one embodiment of the multi-functional belt/blade cleaner of the present invention for cleaning background toner and other material from processing surfaces in a photocopying machine. According to this embodiment, the belt/ blade cleaner comprises a continuous cleaner belt 20 carrying a plurality of cleaning blades 26. The cleaner belt 20 is attached to a thin supporting belt 10 by adhesive or other means, and mounted about rollers 12 and 14. As in the first embodiment, the cleaner belt 20 can be mounted on a thin, elastic supporting belt 10. The cleaner belt 20 and supporting belt 10 are made of flexible materials enabling them to be wrapped about rollers 12 and 14. The flexible cleaner belt 20 can be constructed, for example, from a durable material such as urethane, to provide a long cleaning life. A flexible, elastic material such as mylar is suitable for fabrication of the thin supporting belt 10.

As a particular example, the cleaner belt 20 can be readily fabricated by cutting a belt-like strip from a spin-cast sheet of urethane, or other suitable material. The blades 26 are then formed in the cleaner belt 20 by cutting grooves 24 into the cleaner belt material. The grooves 24 are cut at intervals along a longitudinal length of the cleaner belt 20, and extend across a transverse width substantially perpendicular to the length. The grooves 24 are cut to a predetermined depth to avoid cutting through the cleaner belt 20. Opposite ends of the cleaner belt 20 are subsequently joined to form a continuous belt.

Figure 2:
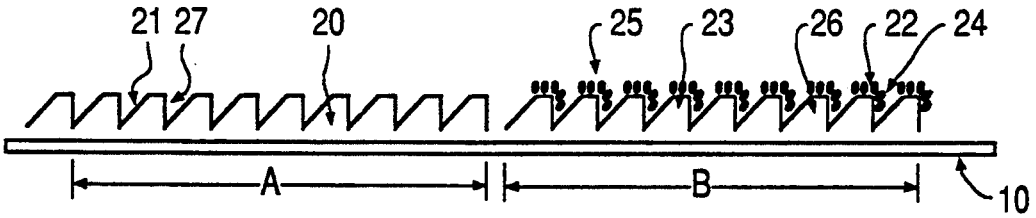
FIG. 2 is an enlarged view showing the blade structure of the belt/blade cleaner of the first embodiment.

As shown in FIG. 2, each blade 26 can be formed by an angled cut 21 and a vertical cut 27 defining a groove 24 and land area 22 with a cleaning edge 23. As a result, wedge-shaped portions of the belt 20 are removed to provide grooves defining a plurality of blades 26. In addition to exposing the cleaning edges 23, the grooves 24 provide a space for deflection of the blade 26 due to blade loading during the cleaning process, and facilitate cleaning of the cleaning edges 23 by a brush or pad.

Figure 3:
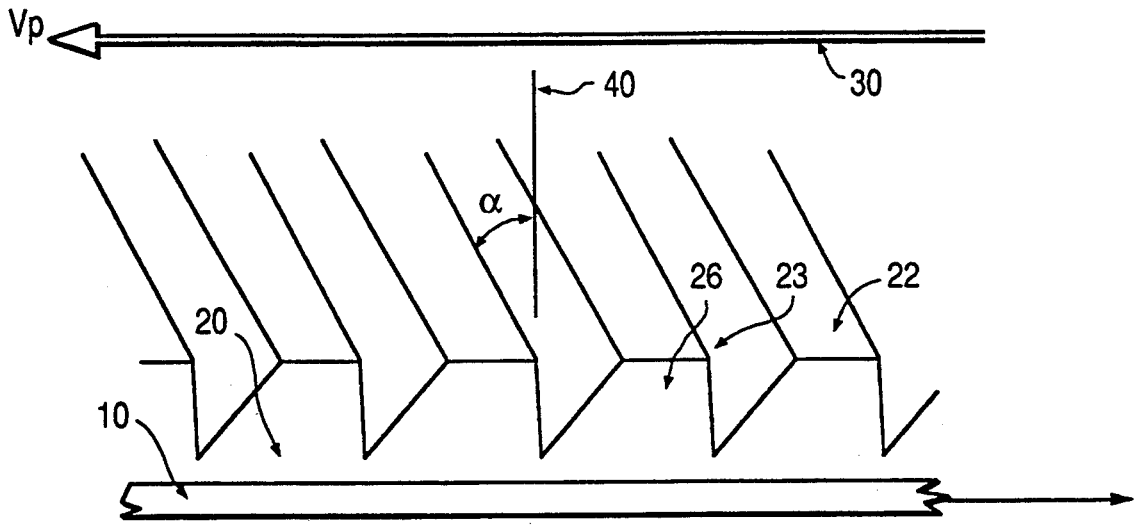
FIG. 3 is an enlarged view of the blade structure of the belt/blade cleaner of the first embodiment illustrating blades oriented at an angle relative to a line perpendicular to the process direction.

Each resulting blade 26 includes a cleaning edge 23 that is designed to contact the surface to be cleaned along the entire length of the blade. With reference to FIG. 3, the cleaning edge 23 can be oriented perpendicular to the process direction Vp, as shown by line 40, or may be cut at a slight angle e relative to line 40. The angled cut of the cleaning edge 23 may be desirable to provide a cutting or shearing action to remove stubborn material adhering to the processing surface.

Figure 4:
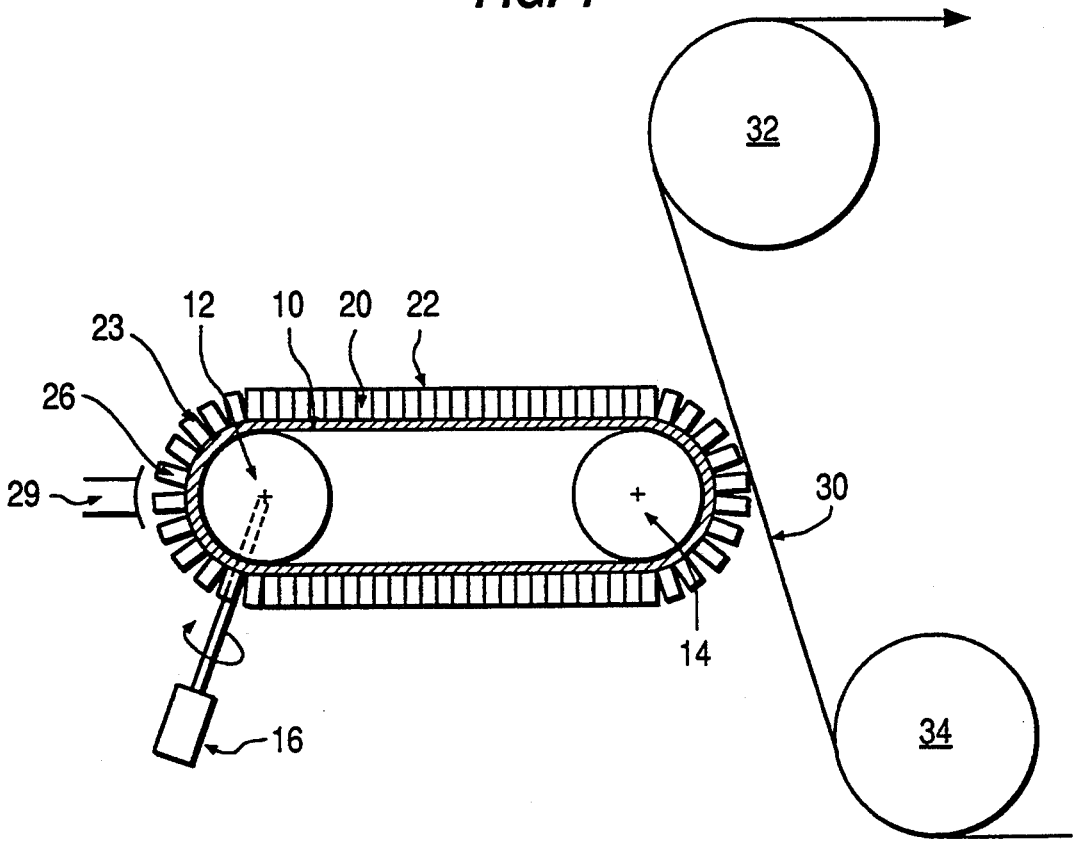
FIG. 4 shows a second embodiment of the multi-functional belt/blade cleaner of the present invention.

According to a second embodiment of the invention, illustrated in FIG. 4, the flexible cleaner belt 20 includes a plurality of blades 26 formed by vertical cuts in the belt surface. Unlike the wedge-shaped grooves of the first embodiment, only vertical cuts are made at an orientation substantially perpendicular to the cleaner belt surface, such that the cleaner belt 20 defines closely spaced blades 26 which fan apart as the belt moves with rollers 12 and 14. In practice, roller 14 is mounted adjacent the processing surface so that one portion of the cleaner belt 20 at which the blades 26 fan apart is used to clean the adherent material. The blades 26 subsequently can be cleaned at a position adjacent roller 12, at which the blades 26 also fan apart.

In the examples of FIGS. 1 and 4, the belt/blade cleaner is shown positioned adjacent to a photoreceptor belt 30 mounted about rollers 32 and 34. However, the belt/blade cleaner is suitable for cleaning a variety of processing surfaces such as photoreceptor drums, intermediate belts, ink imaging surfaces, and biased transfer rolls. To remove adherent material, the belt/ blade cleaner includes means for mounting the cleaner belt 20 to dispose the cleaning edges 23 in wiping contact with the photoreceptor belt 30 or other surface to be cleaned.

For example, the mounting means may consist of a motor 16, coupled to one or both of the rollers 12, 14, for slowly revolving the belt 20. When the cleaner belt 20 is revolved, each of the cleaning edges 23 of the blades 26 is periodically applied to the moving surface of the photoreceptor belt 30 to remove the adherent material. It is noted that, as an alternative to rollers 12 and 14, the cleaner belt 20 and supporting belt 10 could be mounted about a single cylinder (not shown) for revolution against the processing surface.

One advantageous feature of the present invention is that various belt segments designed for diverse cleaning purposes can be attached to the thin supporting belt 10 to form a unitary, multi-functional belt, as shown in FIGS. 1 and 2. For example, segment A can be constructed from a urethane blade material for removing toner and paper debris. Segment B, formed from a higher durometer material designed for the removal of photoreceptor films, can be readily combined with segment A to provide multi-functional cleaning, improving overall cleaning effectiveness. If desired, segment B can also be formed from or treated with an abrasive material 25 for more effective removal of photoreceptor films or impacted matter from the photoreceptor. Of course, the multi-functional aspect of the invention is equally applicable to the belt/blade structures of both the first and second embodiments of the present invention.

The cleaning efficiency of both the first and second embodiments of the present invention is enhanced by the flexible construction of the cleaner belt 20 and blades 26 from flexible materials such as urethane. For example, the flexible belt/blade structure allows the blades 26 to flex during revolution, enabling more than one of the blades 26 to contact the processing surface at the same time. Thus, when more than one blade 26 contacts the processing surface, cleaning efficiency can be improved because the width of the cleaning nip is increased.

Cleaning reliability is also improved by the belt/blade cleaner of the present invention relative to single-blade cleaning systems. For instance, in a system in which only a single rigid blade contacts the processing surface during a cleaning swipe, a nick in the cleaning edges of the rigid blade may result in a streak on the processing surface. If a nick develops in a cleaning edge of one of the plurality of flexible blades 26 of the present invention, however, any resulting streak will be eliminated by the cleaning edge of the other flexible blades 26 which contact the processing surface at the same time.

The belt/blade cleaners shown in FIGS. 1 and 4 also provide effective cleaning without substantially affecting the motion quality of the overall photocopying system. For instance, if the blades 26 are cut perpendicular to the process direction the entire blade 26 contacts the cleaning surface. Because more than one flexible blade 26 engages the cleaning surface at all times, the frictional drag on the moving surface does not fluctuate. Thus, the speed of the moving cleaning surface remains constant.

In addition, if the belt/blade cleaners are applied to cleaning surfaces such as photoreceptor belts or drums and biased transfer rolls having connection seams, impact of a blade 26 oriented parallel to such a seam may result in disruption of the motion quality of the overall photocopying process. Therefore, to preserve the motion quality of the system, it may be desirable to make angled cuts in the belt 10, as shown in FIG. 3, defining cleaning edges 23 oriented at a small angle e relative to the a line 40 perpendicular to the process direction.

This type of blade orientation provides a "gravure" type cleaning action. Because the blade 26 is oriented at an angle $\alpha$ relative to the photoreceptor or BTR seams, only a small part of each blade contacts the seam at any given time. This significantly reduces the impact of the blade with the seam, preserving the motion quality of the system. Furthermore, after the initial portion of the blade 26 impacts a seam, the remainder of the angled blade tends to glide over the seam, avoiding further impact. Thus, the gravure blade orientation provides an improvement, in terms of motion quality, over the parallel blade orientation in which the entire length of the blade abruptly collides with the seam.

An additional advantage of the present invention is an improvement in blade wear characteristics. Because belt 20 provides multiple blades 26 for surface cleaning, it can provide effective cleaning at a relatively slow rate of revolution. In addition to providing ample time for cleaning or other treatments such as lubrication, the slow revolution of the belt 20 improves cleaner reliability in several ways. Because each blade 26 contacts the image surface periodically, the continuous stress on the cleaning edge 23 is reduced. Contaminates, such as carrier beads and paper debris are removed, and localized photoreceptor defects contact the blade 26 fewer times per photoreceptor cycle.

The slow rotation of the cleaner against the photoreceptor also allows the toner and the debris on the cleaning edge 23 to be carried away from the cleaning zone. A detoning area 29 can be provided within each of the belt/blade cleaners shown in FIGS. 1 and 4. After the cleaning edges 23 are rotated away from the cleaning area, material removed from the cleaning surface can be cleaned from the blades 26 in the detoning area 29. For example, the excess toner and debris on the blades 26 can be flicked off the cleaning edge 23 with a flicker bar, air can be used to vacuum the edges clean, or the edges can be wiped or brushed clean. As a result, the cleaning edges 23 are always free of debris that could cause failure.

The present invention provides a substantial improvement in blade life over the single-blade system. For example, the average life of a single blade is approximately five-hundred thousand copies (500kc) before failure occurs. In belt/blade cleaners constructed according to FIGS. 1 and 4, however, two blades are in contact with the cleaning surface at all times. The probability that two adjacent blades will both fail is very low. As an example, if a belt has 64 blades, each blade is used 64 times less than in a single-blade cleaner. This results in an expected average $B_{50}$ life (the point at which fifty percent of the blades have failed) of 17,000kc, or seventeen million copies. Thus, the life of the belt/blade cleaner is thirty-four times longer than the single-blade system. This provides a marked improvement in reliability.

The belt/blade cleaners shown in FIGS. 1 and 4 are also advantageous in that they can be designed and fabricated to fit into a variety of subsystem architectures in the photocopying machine. For example, the flexibility of the belt/blade cleaners enables them to conform to desired processing surfaces, providing increased blade contact. In addition, the structures can be made small in diameter to occupy minimal space inside the photocopying machine.

The utility of the invention is not limited to the removal of toner and other material from processing surfaces in photocopying machines. Rather, the multifunctional belt/blade cleaner of the present invention may be adapted for use in a variety of surface cleaning applications without departing from the scope of the invention.

Other embodiments of the invention will be apparent to those skilled in the art from consideration of the specification and practice of the invention disclosed herein. Thus, it is intended that the specification and examples be considered as exemplary only, with the true scope and spirit of the invention being indicated by the following claims.

What is claimed is:

1. A multi-functional belt/blade cleaner for removing material from a surface to be cleaned, comprising:

a cleaner belt having a length extending in a longitudinal direction, a width extending in a transverse direction substantially perpendicular to said longitudinal direction, and a predetermined thickness;

a plurality of blades formed from said cleaner belt, said blades being formed by a plurality of substantially linear cuts in said cleaner belt, said cuts being made across said width and at predetermined intervals along said length, each of said cuts having a depth less than said thickness, wherein areas on said cleaner belt between adjacent cuts define individual blades having cleaning edges, and wherein said cuts include a succession of alternating first and second cuts intersecting to form wedge-shaped grooves between said blades, and each of said alternating first and second cuts extends across said width of said cleaner belt at an angle relative to said transverse direction; and means for mounting said cleaner belt to dispose said cleaning edges of said plurality of blades in wiping contact with said surface to be cleaned to remove said material, such that the mounting means disposes the cleaning edges of not more than two of the blades in wiping contact with the surface at a time.

2. The multi-functional belt/blade cleaner of claim 1, wherein said cleaner belt is flexible, enabling more than one of said cleaning edges of said blades to be brought into wiping contact with said surface to be cleaned at all times.

3. The multi-functional belt/blade cleaner of claim 1, wherein said cleaner belt is formed from a plurality of connected belt segments.

4. The multi-functional belt/blade cleaner of claim 3, wherein at least one of said belt segments is formed from an abrasive material.

5. The multi-functional belt/blade cleaner of claim 3, wherein an abrasive material is formed on the cleaning edges of at least one of said belt segments.

6. The multi-functional belt/blade cleaner of claim 3, wherein said cleaner belt is mounted on a flexible supporting belt.

7. The multi-functional belt/blade cleaner of claim 1, wherein said cleaner belt is mounted on a flexible supporting belt.

8. The multi-functional belt/blade cleaner of claim 7, wherein said length of said cleaner belt is continuous, and said mounting means includes means for revolving the continuous cleaner belt to periodically being each of said cleaning edges into wiping contact with said surface to be cleaned.

9. The multi-functional belt/blade cleaner of claim 8, wherein said mounting means includes means for mounting said cleaner belt within a photocopying machine at a position proximal to a processing surface of said photocopying machine, and said revolving means includes means for revolving said continuous cleaner belt to periodically being each of said cleaning edges into wiping contact with said processing surface, wherein said material is residual processing material adhering to said processing surface.

10. The multi-functional belt/blade cleaner of claim 9, wherein said processing surface is a photoreceptor surface.

11. The multi-functional belt/blade cleaner of claim 9, wherein said processing surface is a biased transfer surface.

12. The multi-functional belt/blade cleaner of claim 9, wherein said processing surface is an ink imaging surface.

13. The multi-functional belt/blade cleaner of claim 9, wherein said processing surface is an intermediate processing surface.

14. The multi-functional belt/blade cleaner of claim 1, further comprising detoning means, disposed adjacent said cleaner belt, for removing portions of said material adhering to said cleaner belt and said blades.

15. A multi-functional belt/blade cleaner for removing material from a surface to be cleaned, comprising:

a cleaner belt having a length extending in a longitudinal direction, a width extending in a transverse direction substantially perpendicular to said longitudinal direction, and a predetermined thickness;

a plurality of blades formed from said cleaner belt, said blades being formed by a plurality of cuts in said cleaner belt, said cuts being made across said width and at predetermined intervals along said length, each of said cuts having a depth less than said thickness, wherein each of said cuts is a vertical cut made substantially perpendicular to a surface plane of said cleaner belt defined by said transverse direction and said longitudinal direction, and wherein areas on said cleaner belt between adjacent vertical cuts define individual blades having cleaning edges; and means for mounting said cleaner belt to dispose said cleaning edges of said plurality of blades in wiping contact with said surface to be cleaned to remove said material.

16. The multi-functional belt/blade cleaner of claim 15, wherein said length of said cleaner belt is continuous, and said mounting means includes means for mounting said cleaner belt within a photocopying machine at a position proximal to a processing surface of said photocopying machine, and for revolving said continuous cleaner belt to periodically being each of said cleaning edges into wiping contact with said processing surface, wherein said material is residual processing material adhering to said processing surface.

17. The multi-functional belt/blade cleaner of claim 15, wherein said mounting means disposes the cleaning edges of not more than two of said blades in wiping contact with said surface.

18. A multi-functional belt/blade cleaner for removing material from a surface to be cleaned, comprising:

a cleaner belt having a length extending in a longitudinal direction, a width extending in a transverse direction substantially perpendicular to said longitudinal direction, and a predetermined thickness, wherein said cleaner belt is formed from a plurality of end-connected belt segments;

a plurality of blades formed from said cleaner belt, said blades being formed by a plurality of cuts in said cleaner belt, said cuts being made across said width and at predetermined intervals along said length, each of said cuts having a depth less than said thickness, wherein areas on said cleaner belt between adjacent cuts define individual blades having cleaning edges; and means for mounting said blades in wiping contact with said surface to be cleaned to remove said material.

19. The multi-functional belt/blade is continuous, and said mounting means includes means for mounting said cleaner belt within a photocopying machine at a position proximal to a processing surface of said photocopying machine, and for revolving said continuous cleaner belt to periodically bring each of said cleaning edges into wiping contact with said processing surface, wherein said material is residual processing material adhering to said processing surface.

20. The multi-functional belt/blade cleaner of claim 18, wherein at least one of said belt segments is formed from an abrasive material.

21. The multi-functional belt/blade cleaner of claim 18, wherein an abrasive material is formed on the cleaning edges of at least one of said belt segments.

22. The multi-functional belt/blade cleaner of claim 18, wherein said belt segments are formed from a urethane material, and at least one of said belt segments is formed from a urethane material having a durometer higher than a durometer of other belt segments.

23. The multi-functional belt/blade cleaner of claim 18, wherein aid mounting means disposes the cleaning edges of not more than two of said blades in wiping contact with said surface.

* * * * *